US006629422B2

(12) United States Patent
Wellman

(10) Patent No.: US 6,629,422 B2
(45) Date of Patent: Oct. 7, 2003

(54) SEQUENTIAL DEFROSTING OF REFRIGERATED DISPLAY CASES

(76) Inventor: Keith E. Wellman, 11501 SE. 164th, Norman, OK (US) 73026

( * ) Notice: Subject to any disclaimer, the term of this patent is extended or adjusted under 35 U.S.C. 154(b) by 31 days.

(21) Appl. No.: 09/877,565

(22) Filed: Jun. 7, 2001

(65) Prior Publication Data

US 2002/0184900 A1 Dec. 12, 2002

(51) Int. Cl.[7] ..... F25D 21/06; F25B 47/02
(52) U.S. Cl. ..... 62/155; 62/152; 62/156
(58) Field of Search ..... 62/155, 156, 152, 62/151, 154, 234

(56) References Cited

U.S. PATENT DOCUMENTS 2,272,302 A * 2/1942 Krackowizer ..... 62/276 X
2,492,970 A * 1/1950 Curry ..... 62/182 X
3,174,297 A * 3/1965 Kuhn et al. ..... 62/156
3,633,378 A * 1/1972 Toth ..... 62/155 X
4,151,722 A * 5/1979 Willitts et al. ..... 62/234 X
4,993,233 A 2/1991 Borton et al.
5,924,297 A * 7/1999 Wolff et al. ..... 62/152

* cited by examiner

*Primary Examiner*—Harry B. Tanner
(74) *Attorney, Agent, or Firm*—Fellers, Snider, et al.; Bill D. McCarthy

(57) ABSTRACT

The invention is a method and a defroster control circuit to sequentially defrost a series of refrigerated display cases. The method begins by operating the series of refrigerated display cases during a normal refrigeration mode. At the beginning of the refrigeration mode, a refrigeration time is set to zero and an elapsed refrigeration time is subsequently monitored. When the refrigeration time equals an activation time, a defrost mode begins and a defrost cycle for the first case starts. The defrost mode for the first case terminates based either on a defrost time criterion or a defrost temperature criterion. After the first refrigerated display case is defrosted, a refrigeration mode is restarted for the first case. After the first refrigerated display case is defrosted, the other refrigerated display cases in the series of refrigerated display cases are then sequentially defrosted.

14 Claims, 7 Drawing Sheets

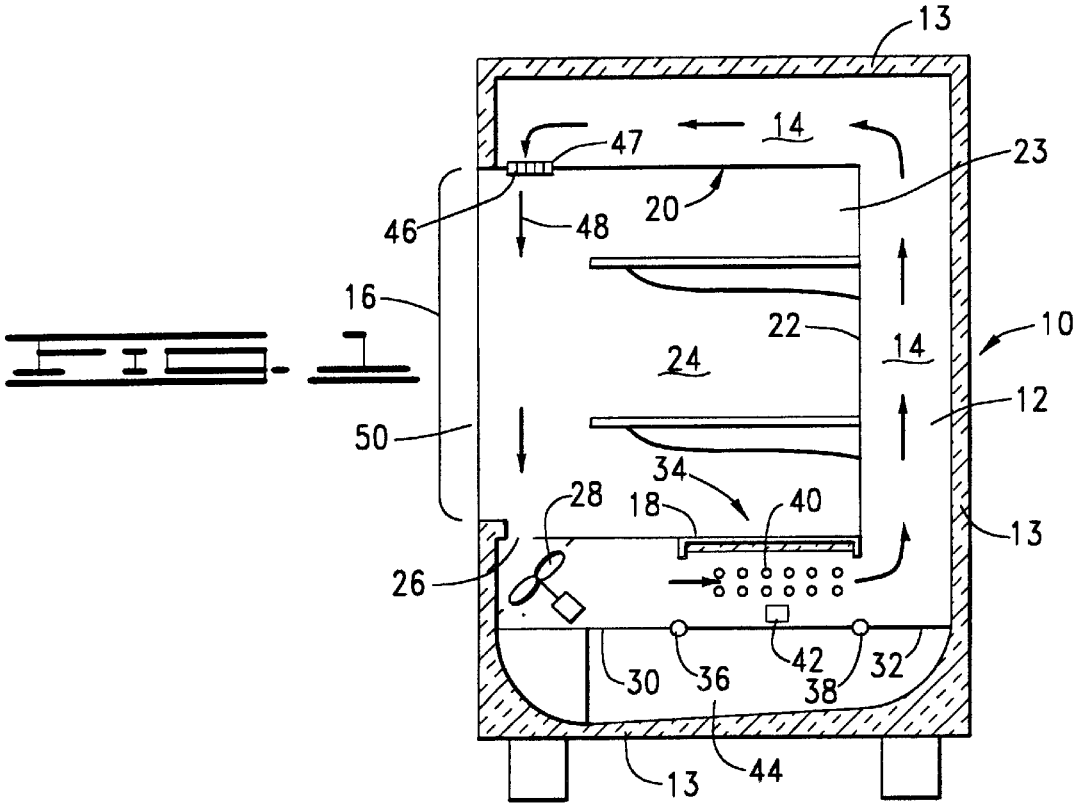
13
14
47
23
46
48
20
16
22
10
24
14
12
50
34
28
18
40
13
26
42
32
30
36
38
44
13
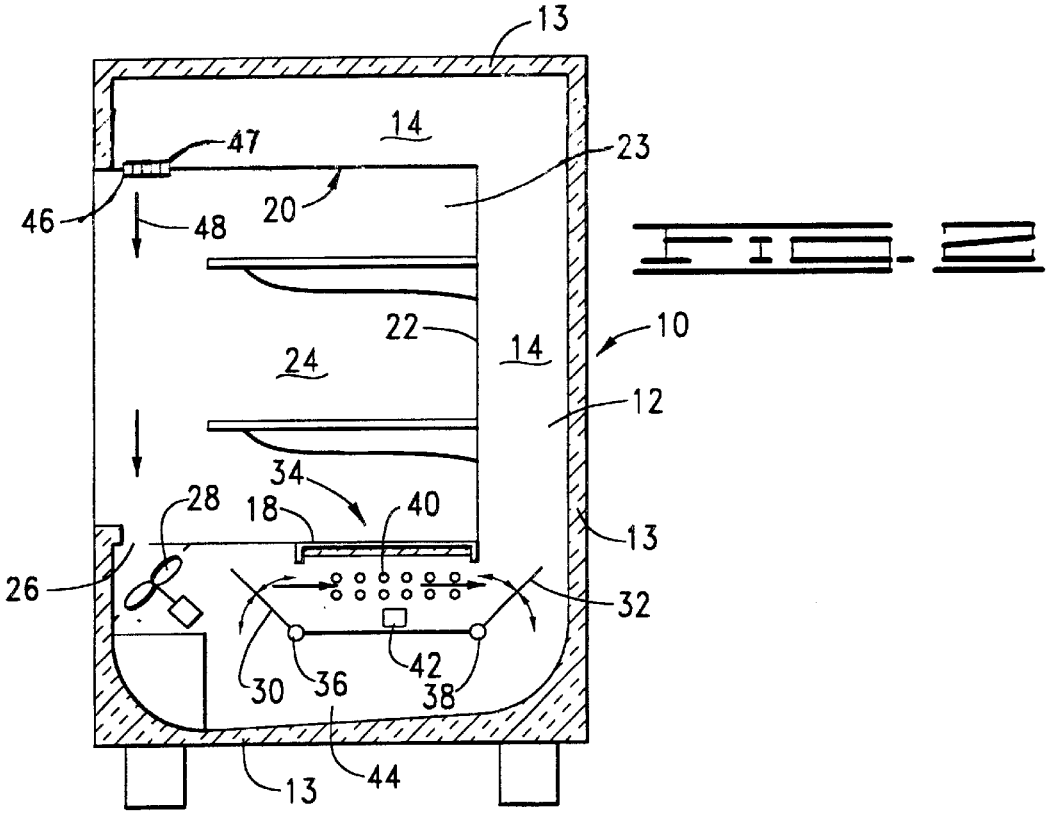
13
14
47
23
46
48
20
22
10
24
14
12
34
28
18
40
13
26
32
42
30
36
38
44
13

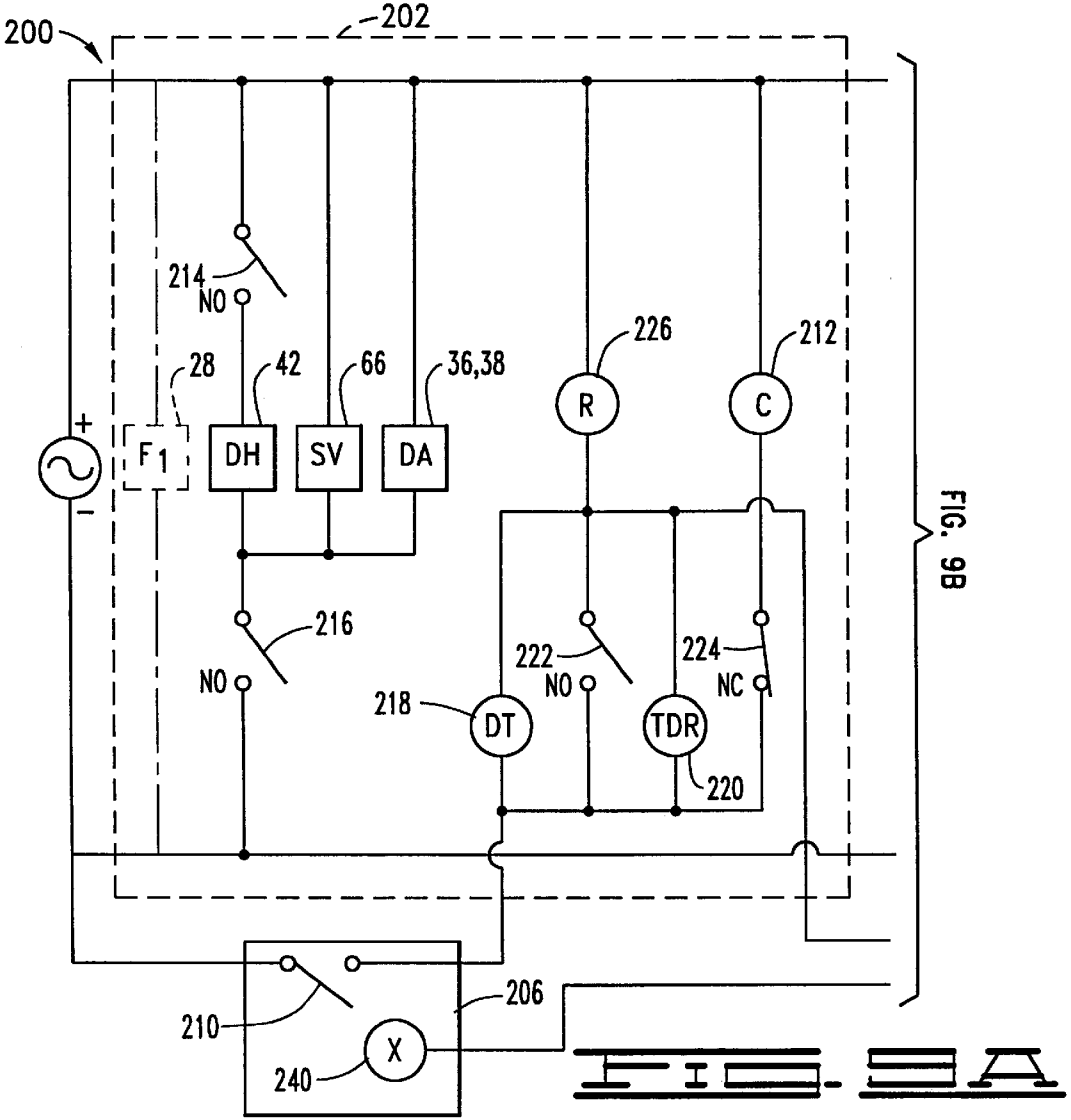
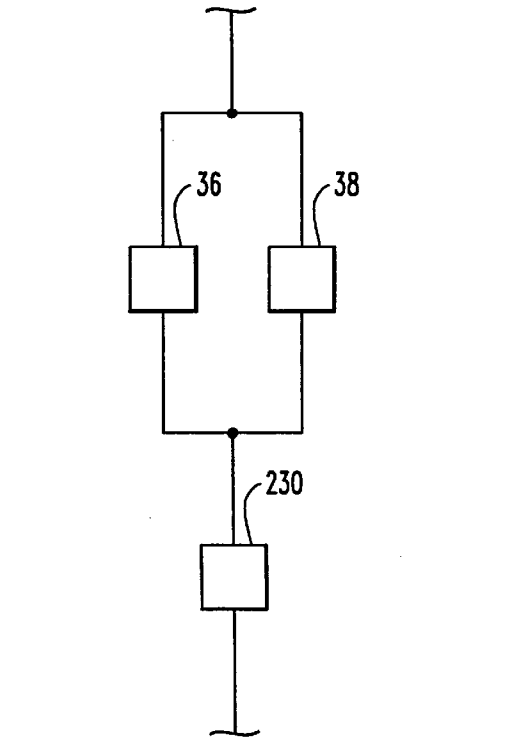
FIG. 10

SEQUENTIAL DEFROSTING OF REFRIGERATED DISPLAY CASES

BACKGROUND OF INVENTION

1. Field of the Invention

The invention generally relates to the field of refrigeration, and more particularly but not by way of limitation, to a control circuit and method for sequentially defrosting refrigerated display cases.

2. Discussion

Refrigerated display cases located in grocery stores and the like are commonly arranged together in a contiguous line or series of cases. The cases are placed side-by-side and often display foods sharing the same refrigeration demands. In refrigerating the case, a fan circulates cold air in a duct that encircles the case. An evaporator coil of a refrigeration system is located in the duct, so that the circulating air is cooled by the cold refrigerant flowing through the evaporator coil.

Over several hours of operation of the refrigeration system, the air flowing through the duct entrains water vapor from the ambient air. This water vapor condenses and freezes on the cold evaporator coil, decreasing the heat transfer efficiency between the refrigerant in the evaporator coil and the air in the duct. Because of this, the evaporator coil needs to be periodically defrosted. Thus, each case has a refrigeration cycle that includes a defrost cycle of operation. During the refrigeration cycle, the refrigeration system cools the case. During the defrost portion of the refrigeration cycle, or that is, during the defrost cycle, a defrost heater melts condensation that has frozen on the evaporator coil.

Defroster heaters are located in the duct near the evaporator coils. An improved evaporator/defroster unit is described in related U.S. application Ser. No. 09/877,566, entitled "An Enclosable Evaporator/Defroster Unit for a Refrigerated Display Case." In the related application, the evaporator/defroster unit is positioned in the air duct so that, by closing dampers, an enclosure is formed about the evaporator coil to prevent heat transfer from the enclosure during the defrost cycle. Such dampers are automatically closed by actuators during the defrost cycle. Closing the dampers retards heat transfer from the enclosure by all three modes of heat transfer, namely by convection, conduction, and radiation. This allows operation of the fans that circulate air through the ductwork during the defrost cycle. Thus, an air curtain can be maintained across an access opening for the case during the defrost cycle.

It is now common practice to defrost the evaporator coils in a series of cases at the same time, in part because contiguous refrigerated display cases often share a common defrost timer. It is also common to defrost the evaporator coils every 6–8 hours. There are several notable problems with this approach to defrosting the evaporator coils of several cases at the same time.

One problem is that defroster units of the existing art generate a lot of water vapor during a defrost cycle. If a line of contiguous cases is defrosted at the same time, an undesirable frost build-up occurs within the case.

Another problem caused by defrosting the cases at the same time is the need for greater electrical power at the same time. Because the defroster unit wiring is often on the same circuit for a given series of cases, this in turn causes a need for larger wiring sizes to carry the high current demand required for the defrost cycle. Additionally, because the cost of power from public utilities is often based on peak demands, the cost of power may be greatly increased by defrosting all the cases at the same time.

Yet another problem with defrost control systems of the existing art is that many are highly complex with digital components and programmable controllers. This makes repairs difficult for repairmen of ordinary skill in the refrigeration art, who are often only familiar with non-digital electrical components. The term "non-digital" refers to relays, contactors, sensors, coils, switches and any other component that generally does not process digital information.

One of the most expensive aspects of the existing practice of defrosting a series of contiguous cases at the same time is that it often leads to food spoilage. By shutting down the refrigeration cycles of contiguous cases at the same time, there can be an increase in the temperature of the food product in the cases. Also, there is often a greater increase in the display section temperature of each case due to the combined effect of defrosting several contiguous cases at the same time.

Thus, there is a need for an improved method and apparatus for defrosting refrigerated display cases that avoid the problems created when refrigerated display cases are simultaneously defrosted and that avoid the problems of having complex digital components.

SUMMARY OF THE INVENTION

The present invention provides a method and a defroster control circuit for sequentially defrosting a series of refrigerated display cases. At the beginning of the refrigeration cycle, a refrigeration time is set to zero and an elapsed refrigeration time is subsequently monitored. When the refrigeration time equals an activation time, the defrost cycle for the first case is started. The defrost cycle for the first case terminates based either on a defrost time or temperature criterion.

After the first refrigerated display case is defrosted, the refrigeration cycle restarts for the first case and the evaporator coils in the other refrigerated display cases in the series of refrigerated display cases are sequentially defrosted. When all the refrigerated display cases in the series have been defrosted, the elapsed refrigeration time is reset to zero and the normal refrigeration cycle is resumed for the last case defrosted.

The advantages and features of the present invention will be apparent from the following description when read in conjunction with the accompanying drawings and appended claims.

BRIEF DESCRIPTION OF THE DRAWINGS

FIGS. 1 through 3 are semi-detailed, diagrammatical side views of a refrigerated display case constructed in accordance with the present invention, the views depicting different times in the refrigeration cycle.

FIG. 8 is a flow chart that illustrates the method for sequentially defrosting a line of cases.

FIGS. 9A and 9B together show a circuit diagram for a defroster control circuit that performs the functions described in the method of FIG. 8.

FIG. 10 is a circuit diagram for the damper actuator sub-circuit.

FIG. 11 is a view of a portion of a circuit diagram for a defroster control circuit with a manual override timer relay.

DESCRIPTION

Figure 3:
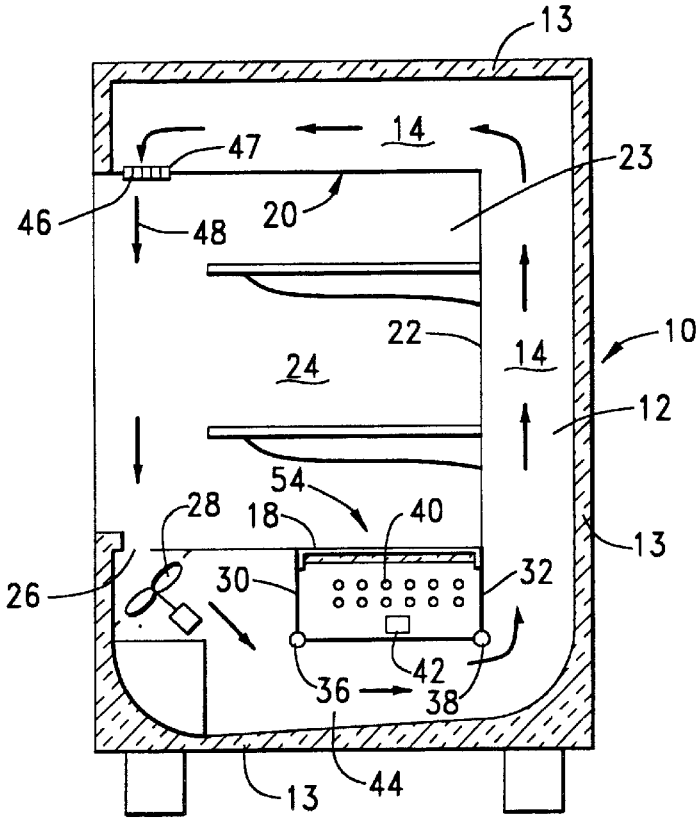

Referring to FIG. 1, a refrigerated display case 10 has a cabinet 12, about which refrigerated air circulates to refrigerate the cabinet 12. A layer of thermal insulation 13 is positioned on the periphery of the cabinet 12. The refrigerated air flows through an air duct 14 that is shaped to form a substantially closed circular path. The cabinet 12 has an access opening 16 to access refrigerated objects displayed in the case 10. The cabinet 12 also has a floor 18, a ceiling 20, a rear interior wall 22, and side walls 23 (one shown in FIG. 1). In some embodiments, a glass door covers the access opening 16. Refrigerated objects, such as meat, milk or ice cream, are displayed to customers in a display section 24 of the case 10.

During a refrigeration cycle, an electric fan 28 draws air into the air duct 14 at inlet opening 26. Hinged dampers 30 and 32 are in an open position so that air moves through an evaporator unit 34. Actuators 36 and 38 are provided to move the dampers 30 and 32 selectively between the open position, as shown, and a closed position, as shown in FIG. 2. As air is moved by the fan 28 past a cold evaporator coil 40 in the evaporator unit 34, heat exchange occurs between the relative warm air and the cold refrigerant in the evaporator coil 40. A defroster heater 42 is provided for the purpose described below, and during the refrigerator cycle the defroster heater is not turned on. During the refrigerator cycle, air is prevented from passing through a lower space or portion 44 of the air duct 14. In practice, it is desirable that the lower portion 44 have a height of at least 3 inches in order to ensure sufficient space for flow of air through the air duct 14.

The cold air from the evaporator unit 34 rises in the portion of the air duct 14 behind the rear wall 22, passes through the portion of the air duct 14 above the ceiling 20, and exits the air duct 14 at an outlet opening or grille 46. The cold air in the air duct 14 refrigerates the floor 18, the rear wall 22, the ceiling 20 and the display section 24. Air exiting the outlet opening 46 forms an air curtain 48 in an air duct gap 50 because of the vacuum pressure the fan 28 creates at the inlet 26.

For the present embodiment, the air duct gap 50 coincides with the access opening 16, although this is not required by the present invention. Under normal conditions, the flow in the air curtain 48 is not very strong and is nearly imperceptible, so that a person may comfortably access refrigerated objects in the refrigerated display case 10. However, the air flow should be adequate to prevent very much warm ambient air from entering the inlet 26.

FIG. 2 shows the refrigerated display case 10 of FIG. 1 at a different time of operation in the refrigeration cycle. That is, FIG. 2 shows the refrigerated display case 10 just before a defrost cycle is to begin. The actuators 36 and 38 are moving the dampers 30 and 32, respectively, from the open position to the closed position. The operation of the electric fan 28 is continued because the air in the air duct 14 is protected from heat gain, as described below. At this time, refrigerant has stopped circulating through the evaporator coil 40.

FIG. 3 shows the refrigerated display case 10 during the defrost portion of the refrigeration cycle. As shown in FIG. 3, the actuators 36 and 38 have moved the dampers 30 and 32, respectively, from the open position to the closed position. During this time, the electric fan 28 can continue to operate because the air passing through the air duct 14 is isolated from heat gain, as described below. Also, during this time, refrigerant has been stopped from circulating through the evaporator coil 40, and the defroster heater 42 has been activated.

Figure 5:
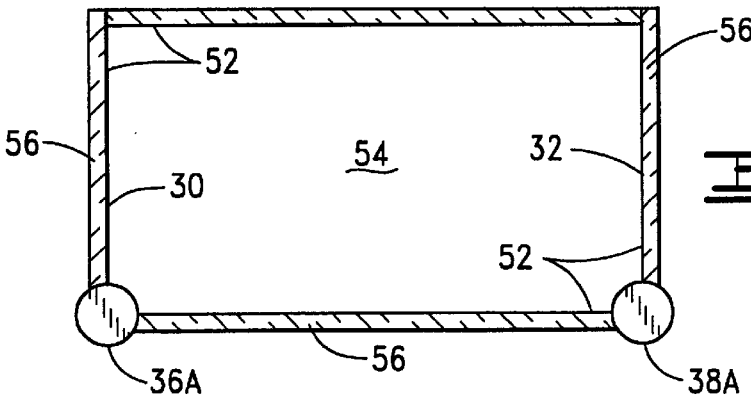
FIG. 5 is a semi-detailed, cross sectional side view of one embodiment of an evaporator enclosure for an evaporator coil and a defroster heater.
Figure 6:
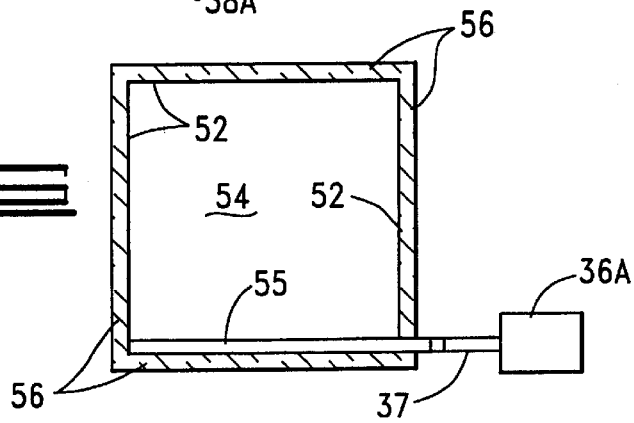
FIG. 6 is a semi-detailed, cross sectional front view of one embodiment of an evaporator enclosure for an evaporator coil and a defroster heater.

The defroster heater 42, an electric heater or a hot gas heater, is positioned near the evaporator coil 40 to melt any frozen condensation that has accumulated during the refrigeration cycle. A reflective material 52 is applied to the inside surfaces of a generally box-like evaporator enclosure 54 of the evaporator unit 34 to inwardly reflect radiation emanating from the defroster heater 42. The closing of the dampers 30 and 32 closes the evaporator enclosure 54. The reflective material 52 may be a reflective paint, reflective tape or a separate liner made from a reflective substance, such as aluminum or stainless steel. Furthermore, an insulating material 56, best shown in FIGS. 5–6, is located on the outside of the enclosure 54 to retard heat transfer from the evaporator enclosure 54 whether by heat conduction or heat convection. Water produced by the defrosting of the evaporator coil 40 is collected and disposed through a drain (not shown).

It is important to note that the provision of the evaporator enclosure 54 around the evaporator unit 34 reduces the amount of energy lost to the surroundings in melting the frozen condensation from the evaporator coil 40. This results, in part, from the retention of heat by the evaporator enclosure 54 by the reflective material 52 and by the insulating material 56. This reduction of lost energy is also due in part to the closing of the dampers 30 and 32, which prevents airflow to the evaporator coil 40 during the defroster portion of the refrigeration cycle, thereby reducing energy loss from heat convection.

Furthermore, the time required to defrost the evaporator coil is greatly reduced. As a result, the efficiency losses associated with having to shut the refrigeration system down during a longer defrost cycle are also reduced, thereby increasing the energy savings over that from a shorter defrost cycle alone.

Figure 4:
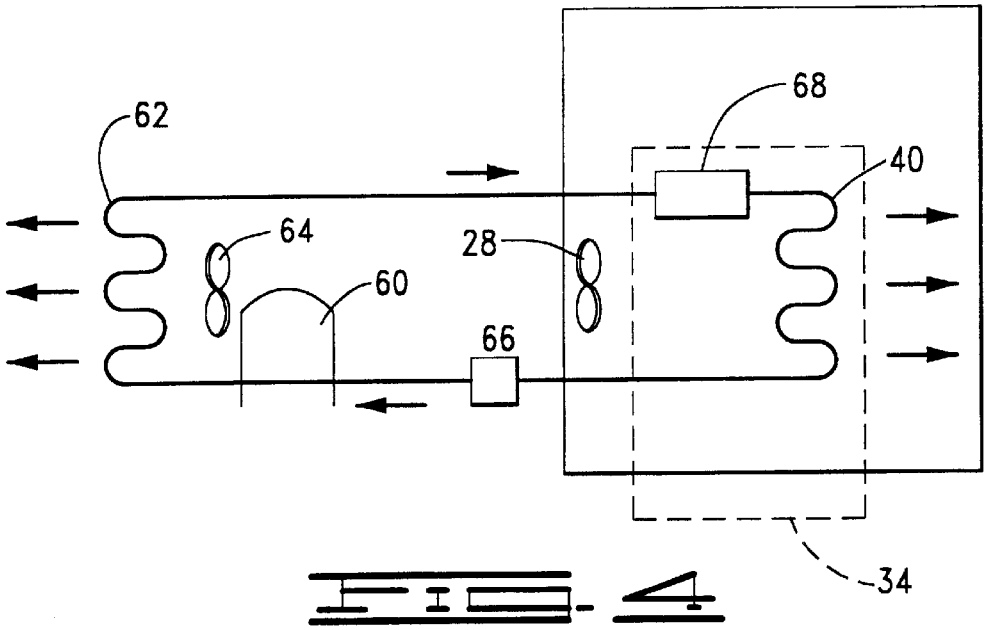
FIG. 4 is a schematic representation of a refrigeration unit as embodied by the present invention.

In FIG. 4, a schematic representation shows the operation of the mechanical components of the refrigeration system used to cool the refrigerated display case 10. A compressor 60 compresses refrigerant in a gaseous state. The compressed refrigerant passes then through a condenser coil 62, over which a fan 64 blows cool ambient air, to remove heat. The removal of heat from the refrigerant causes it to condense into a liquid.

The liquid refrigerant then flows through a metering device 68 where it expands to a gas and moves through the evaporator coil 40. The refrigerant absorbs heat in changing from a liquid to a gas, causing the air in the air duct 14 to cool as the fan 28 blows the air over the cold evaporator coil 40. The expanded gas exits the evaporator coil 40 and passes through a solenoid valve 66 that shuts off the flow of refrigerant during the defrost cycle. The expanded gas refrigerant returns to the compressor 60 to begin the refrigeration cycle again.

FIGS. 5 and 6 show the evaporator enclosure 54 that surrounds the evaporator unit 34. The evaporator enclosure 54 is normally open and the dampers 30 and 32 are in the open position during a refrigeration cycle. As shown in FIGS. 5 and 6, the dampers 30 and 32 are in the closed position. Preferably, all interior surfaces of the evaporator enclosure 54 are covered with reflective material 52, and all exterior surfaces of the evaporator enclosure 54 are covered with an insulating material 56, including the dampers 30 and 32. Two electric actuator motors 36A and 38A move the dampers 30 and 32 between the open and closed position. Although FIGS. 5 and 6 show two electric motors 36A and 38A, the electric motors 36A and 38A could be hydraulic motors, or a single electric motor combined with a mechanical linkage.

As shown in FIG. 6, the damper 30 is rigidly attached to an axle 55. The electric motor 36A has a drive shaft 37 coupled to the axle 55. Rotation of the motor drive shaft 37 causes the axle 55 to rotate and causes the damper 30 to move to the open or the closed position. In one embodiment, the non-hinged ends of the dampers 30 and 32 engage a compressible material in closing and form a tight seal to prevent leakage of heat by convection. In another embodiment, radial springs on the axles bias the dampers in the open position, so that if one of the components of the defroster unit malfunctions, the refrigerated display case may still operate, albeit inefficiently.

Figure 7:
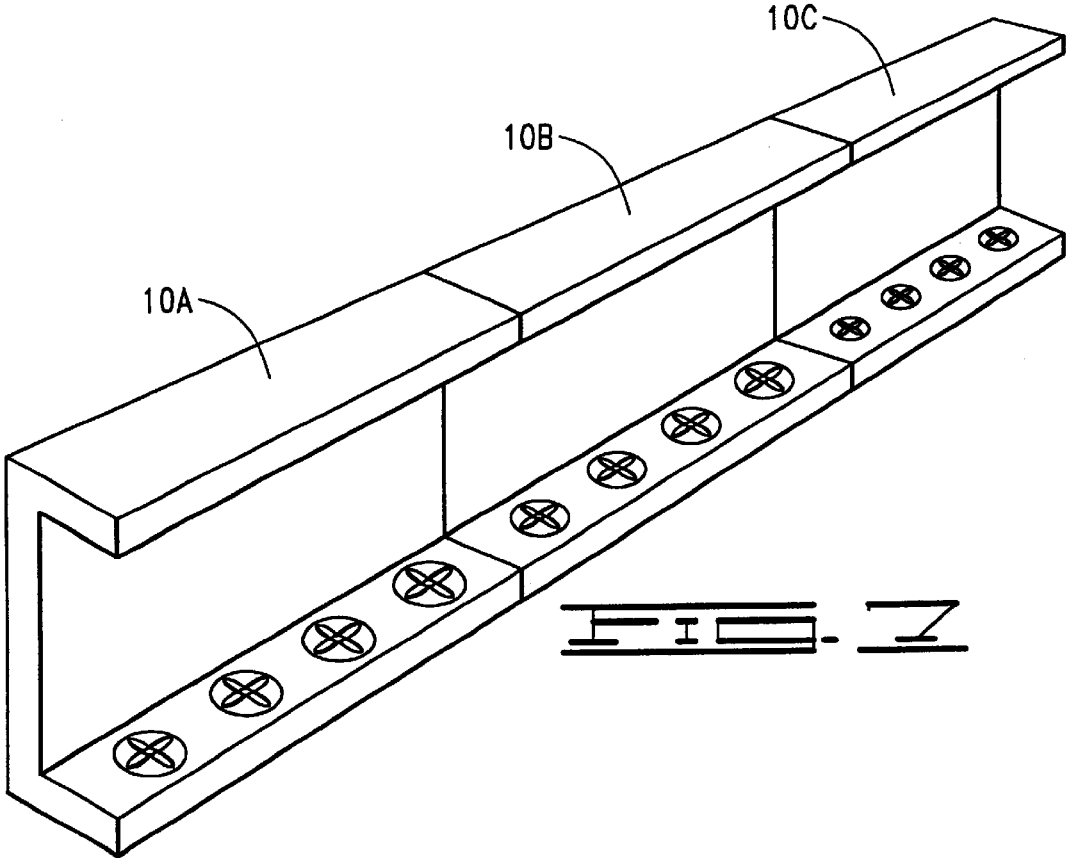
FIG. 7 is an isometric, semi-detailed diagrammatical view of a line of contiguous refrigerated display cases.
Figure 4:
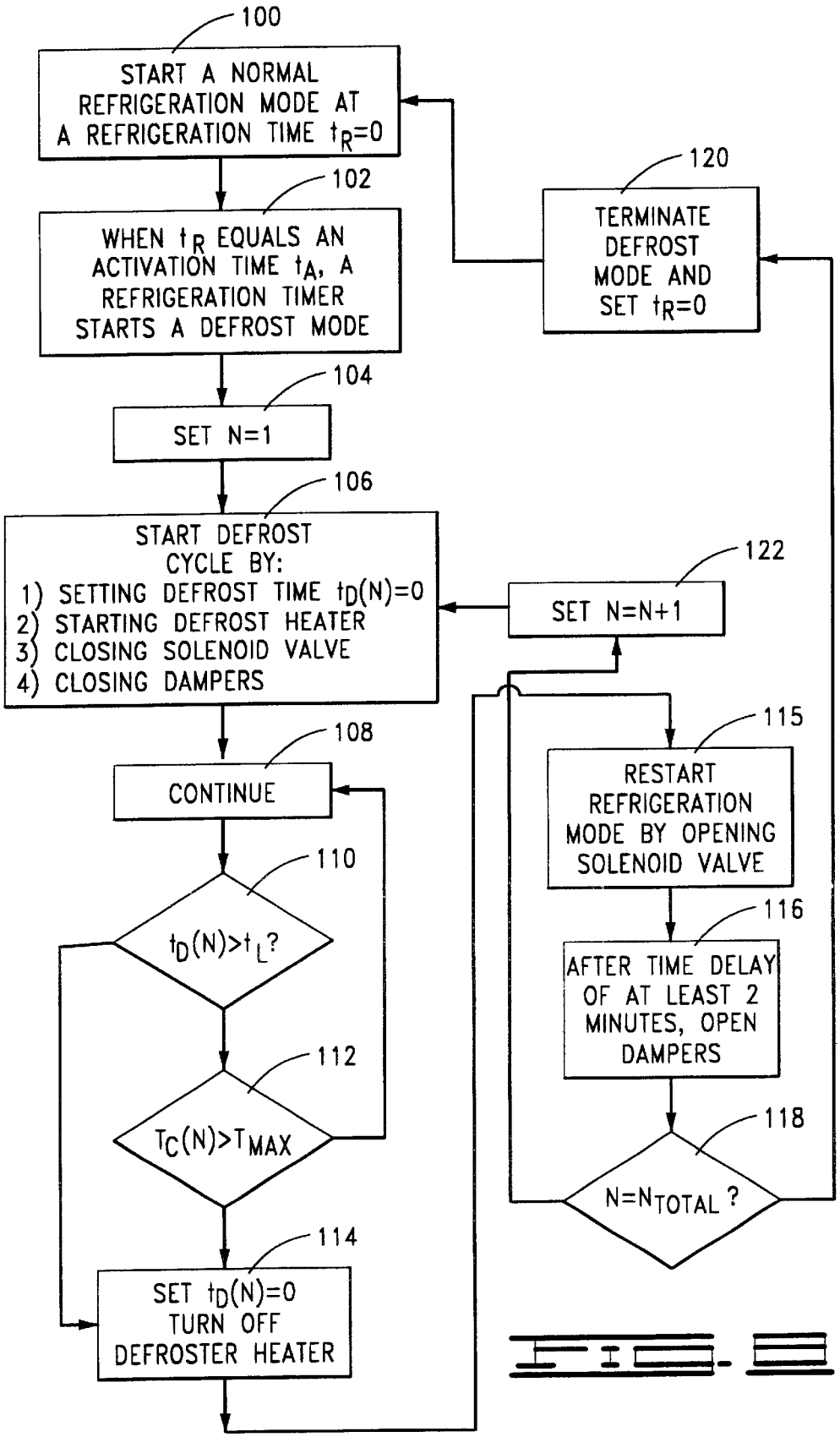

FIG. 7 shows three contiguous cases 10A, 10B, and 10C as they would be positioned in a grocery store. As shown, the cases 10A, 10B and 10C have open-front type cabinets, and the side walls 23 are omitted for better viewing.

Before describing the present inventive method for sequentially defrosting a series of cases, it is useful to define terms of operation. A "normal refrigeration mode" is defined to be a state that exists when refrigeration systems of all cases in the series of cases are operational. A "defrost mode" is a state that exists when a defrost system for any one of the cases is operating. A refrigeration mode occurs for a particular display case when refrigerant is flowing through the evaporator coil for that display case. A defrost mode occurs for a particular display case when refrigerant is not flowing through the evaporator coil and the defroster heater is operating.

Furthermore, as used herein, the phrase "defrosting a case" is synonymous with the phrase "defrosting the evaporator coil of a case." The meaning of both phrases is that frozen condensation is being removed from the evaporator coil of a display case.

FIG. 8 is a flow chart for controlling the operation of a series of refrigerated display cases and sequentially defrosting the evaporator coils of refrigerated display cases in accordance with the present invention. For this flow chart, there are three time-dependent variables: (1) $t_r$, which is the refrigeration time between defrost modes; (2) $t_d(N)$=a defrost time that is started when a defrost mode begins for a particular refrigerated display case (the Nth case); and (3) $T_c(N)$ which is the temperature measured near the evaporator coil for the Nth case. N is a case counter corresponding to a particular case. These are the independent variables that determine the actions occurring in the method for sequentially defrosting a series of cases and when the actions occur.

There are several constants that do not change during the method. The total number of cases to be defrosted is designated as $N_{total}$. The activation time, $t_A$, is the time between the end of a defrost mode to a start of another defrost mode for the same case. The exact value of $t_A$ depends upon the number of cases in the series of refrigerated display cases. The time between the start of two defrost modes for any given case is typically on the order of 6–8 hours. The time limit $t_L$ is the maximum time allowed for a particular case to be defrosted and is typically about 15–20 minutes. The temperature $T_{max}$ is the maximum value of $T_c(N)$ which will cause the defrost mode to terminate. The value of $T_{max}$ is typically between about 40° F. to 50° F.

The method begins at step 100, where a normal refrigeration mode starts for the first refrigerated display case at $t_r$=0. After the passage of time $t_A$, a refrigeration timer generates a signal to begin a defrost mode, as shown for step 102. In step 104, a case counter is initialized at N=1.

At step 106, the defrost mode begins for the first case by closing the refrigerant solenoid valve 66 to stop the flow of refrigerant inside the evaporator coil 40, closing the dampers 30 and 32, and starting the defrost heater 42. The defrost time for case N is initialized at $t_d(N)$=0 and the defrost timer is monitored. Nothing occurs at the "CONTINUE" step 108. The use of step 108 in explaining the flow of the method will become apparent in the description that follows.

At a test step 110, the defrost time elapsed since the beginning of the defrost mode $t_d(N)$ for case N is tested to determine whether the defrost time limit $t_L$ for case N has been exceeded. If the elapsed defrost time $t_d(N)$ equals $t_L$, the method skips step 112 and goes directly to step 114.

The purpose of the test step 110 is to terminate the defrost mode for a particular case if one of the defroster heater 42, the solenoid valve 66, or the damper actuators 36, 38 is not operating normally. If one of these components, such as the defroster heater 42, is malfunctioning, the temperature $T_{max}$ may never be reached. Thus, when the defrost time $t_d(N)=t_L$, the method bypasses the temperature test step 112 and proceeds to the steps 114 and 116 for terminating the defrost mode for that particular case N. The defrost time limit $t_L$ should be long enough to permit a normal defrosting operation of one case, which is typically on the order of 15–20 minutes. It is important to note that the refrigerated display case is still capable of refrigeration when one of the defroster heater 42, the solenoid valve 66, or the damper actuator 36, 38 malfunctions.

At test step 112, the temperature near the evaporator coil $T_c(N)$ is tested to determine whether it exceeds the maximum temperature $T_{max}$. If $T_c(N)$ does not exceed $T_{max}$, then the method returns to the continue step 108. If $T_c(N)$ does exceed $T_{max}$, then the method proceeds to step 114. The method arrives at step 114 either through the mere passage of time or by raising the temperature $T_c(N)$ near the evaporator coil to $T_{max}$. Thus, the defrost mode terminates by a temperature criterion or by a defrost time criterion.

At step 114, the defrost time $t_d(N)$ is set back to zero so that it is reset for the next defrost mode, the defroster heater 42 is turned off and the defrost mode has ended for that particular case. At step 115, the refrigeration mode is restarted for case N by reopening the solenoid valve 66 so that refrigerant starts flowing through the evaporator coil 40 again.

At step 116, after a time delay of about 2–3 minutes from the time of the reopening of the solenoid valve 66, the damper actuators 36, 38 return the dampers 30, 32 to the open position. The purpose of the time delay is to allow any residual steam that is generated during the defrost cycle to re-condense onto the evaporator coils 40. Most of the melted condensation is drained off as liquid water during the defrost cycle, but a residual amount of steam, or water vapor, remains in the enclosure. It is generally undesirable to suddenly introduce the steam or water vapor into the air flow that circulates the air about the refrigerated display case. If the refrigerated display case has glass doors, the moisture would fog up the glass and block the "display" function of the case. If the case has an open front, the steam would generate a vapor cloud and would undesirably increase the humidity in the case.

The next step in the method is the test step 118, which determines whether the evaporator coils in all the cases have been defrosted, in which circumstance $N=N_{total}$. If the case number N is less than $N_{total}$, then the case number N is updated to N+1 at step 122, and the method goes back to step 106. If the case number N is equal to $N_{total}$, then the evaporator coils in all of the cases have been defrosted, the defrost mode is terminated and the refrigeration time $t_r$ is reset to zero at step 120. Next, the method returns to the normal refrigeration mode at step 100.

Thus, the method depicted in FIG. 8 defrosts the evaporator coils for successive cases in the series of refrigerated display cases one at a time. While one case is in a defrost mode, each of the other cases is still in a refrigeration mode. As used herein, the term "successive" means following an order. For example, the second case in the series of cases is the successive case with respect to the first case.

Figure 9A:
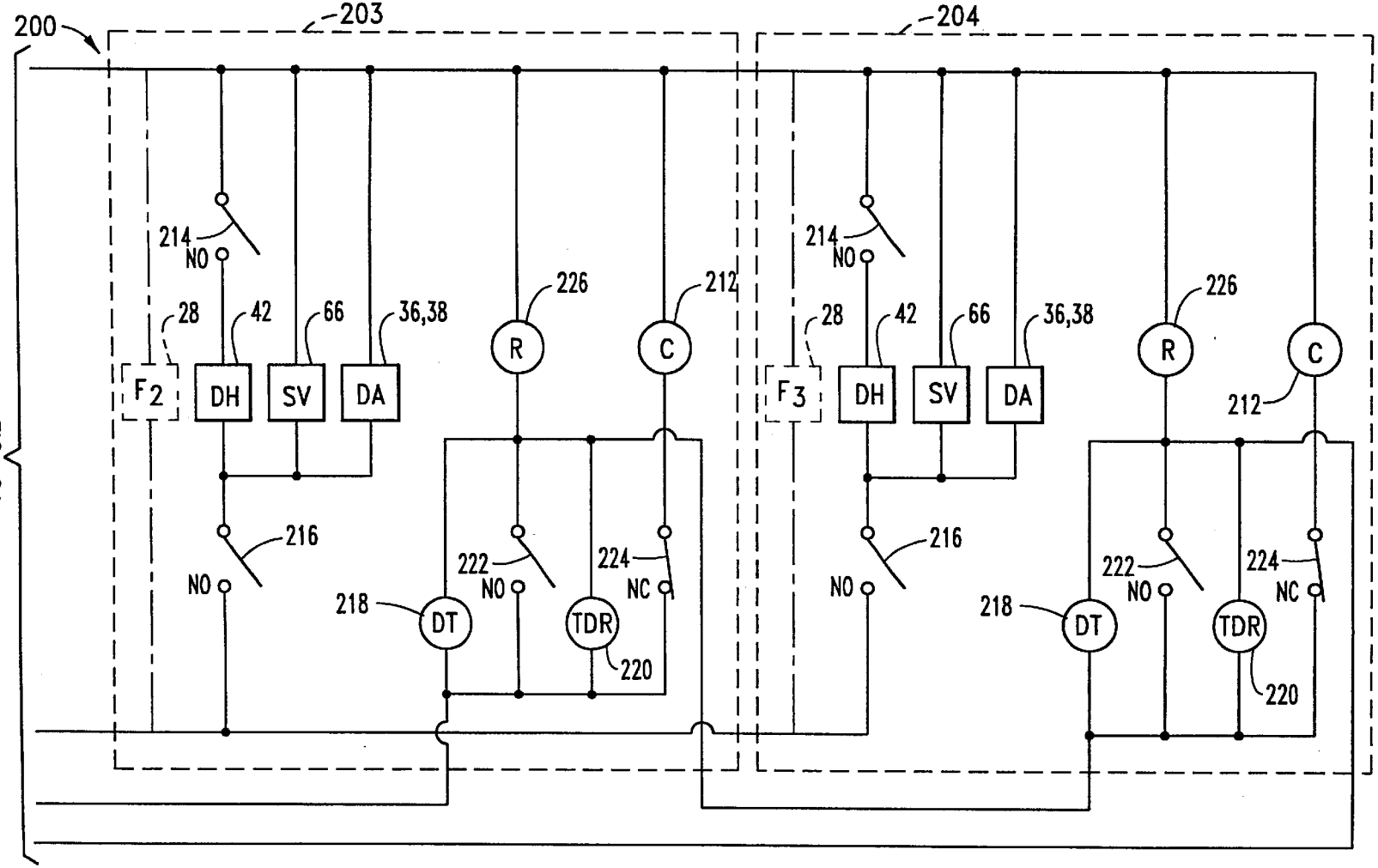
Figure 7:
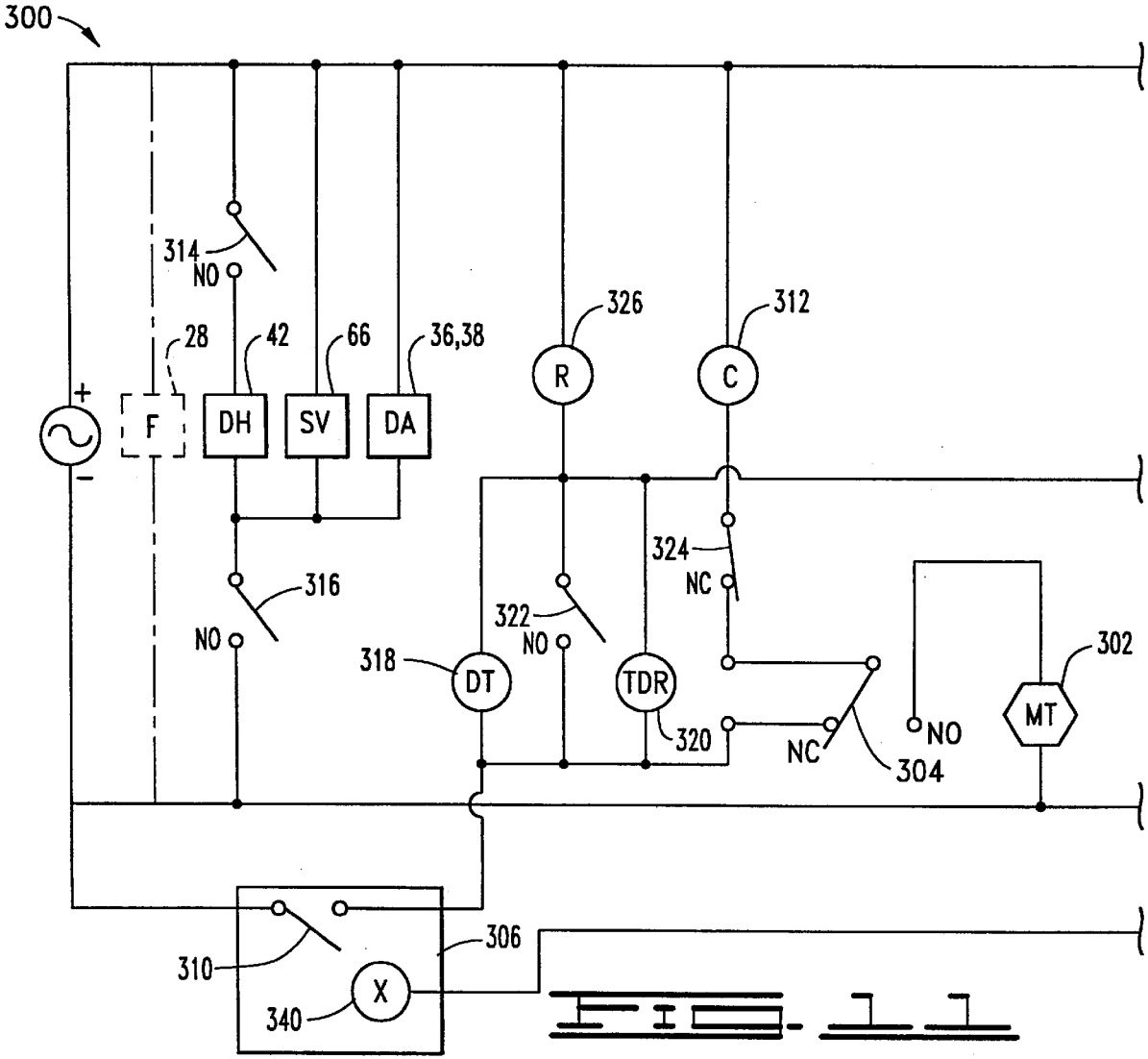

FIGS. 9A and 9B together show a circuit schematic for a defroster control circuit 200 that operates in accordance with the flow chart of FIG. 8. In FIGS. 9A, 9B, the electrical sub-circuits 202, 203 and 204 of three refrigerated display cases are connected such that the first case is defrosted, then the second case is defrosted and then the third case is defrosted. The air circulating fans 28 are not part of the control sub-circuits 202, 203 and 204. When a refrigeration timer 206 sends a signal at refrigeration time $t_r=t_A$, a defrost timer switch 210 closes.

When the defrost timer switch 210 closes, a relay sensor and actuator 226 senses a voltage change and responds by closing a normally open (during the refrigeration mode) first relay switch 222 and opens a normally closed second relay switch 224. A contactor sensor and actuator 212 senses a voltage change when the defrost timer switch 210 closes and responds by closing first contactor switch 214 and second contactor switch 216. When the first contactor switch 214 and the second contactor switch 216 close, the sub-circuit 202 supplies power to the defrost heater 42, the solenoid valve 66, and the damper actuators 36, 38. When power is supplied to these circuit elements, the defroster heater 42 begins heating, the dampers 30, 32 close (shown in FIGS. 1–3) and the solenoid valve 66 shuts off the flow of refrigerant to the evaporator coil 40. Also, the closing of the first relay switch 210 starts a case timer (not separately shown) at a defrost time $t_d(N)$ equal to zero. The case timer is an integral part of a time delay relay 220. The case timer monitors the defrost time $t_d(N)$.

After the defroster heater 42 has warmed a temperature sensor (not separately shown) on a defrost terminator 218 in an area near the evaporator coil 40 (shown in FIGS. 1–3) to a temperature $T_{max}$, which is about 40° F. to 50° F., the defrost terminator 218 opens. The defrost terminator 218 is a temperature-actuated relay with a switch that is opened or closed by a temperature sensor and actuator. When the defrost terminator 218 opens, the relay sensor and actuator 226 senses a voltage change and responds by opening first relay switch 222 again and then closes the second relay switch 224 again.

When the second relay switch 224 closes again, the contactor sensor and actuator 212 senses a voltage change and responds by reopening the first contactor switch 214 and the second contactor switch 216. This shuts off power to electromechanical circuit components, such as the defroster heater 42, the solenoid valve 66, and the damper actuators 36, 38. The damper actuators 36, 38 in FIGS. 9A, 9B are shown for simplicity as a single circuit element and the operation of the damper actuators 36, 38 is discussed further in relation to FIG. 10.

If the defrost terminator 218 does not open within a time limit $t_L$, the time delay relay 220 opens at time $t_L$. When this occurs, the relay sensor and actuator 226 senses a voltage change and opens the first relay switch 222 and closes the second relay switch 224. Also, the contactor sensor and actuator 212 senses a voltage change when the second relay switch 224 opens and responds by opening the first contactor switch 214 and the second contactor switch 216. This shuts off power to the defrost heater 42, the solenoid valve 66, and the damper actuators 36, 38. Thus, the termination of the defrost mode occurs based on either a time criterion or a temperature criterion.

At this point, the current to the electromechanical circuit components, which include the defroster heater 42, the solenoid valve 66 and the damper actuators 36, 38, has been cut off for the sub circuit 202 and the current is passed through to sub-circuit 203. In essence, it is as if a switch had closed to supply power to the sub-circuit 203, much as occurs when the refrigeration timer 206 closes defrost timer switch 210 to start the defrost cycle in sub-circuit 202. Thus, the sub-circuit 203 will operate in the same manner as the sub-circuit 202. Furthermore, the wiring for any number of refrigerated display cases can be connected together in the same manner as one connected sub-circuit 203 to sub-circuit 202. This allows for the successive defrosting of an arbitrary number of refrigerated display cases while using wiring sized to meet the demands of one refrigerated display case.

The wiring is slightly different for the final sub-circuit in the series of sub-circuits (corresponding to the series of refrigerated display cases). As shown in FIGS. 9A, 9B, the sub-circuit 204 is slightly different than sub-circuit 202 or 203. However, all circuit components of the sub-circuit 204 operate in the same way as the elements operate in the sub-circuits 202 and 203 until the defrost mode for the sub-circuit 204 terminates.

When the final sub-circuit 204 terminates the defrost mode, a defrost mode terminator 240 senses a change in voltage and responds by opening switch 210. Opening switch 210 terminates the defrost mode and the refrigeration timer 206 is reset to zero.

For the embodiment shown in FIGS. 9A, 9B, the following components are referred to as "simple" electrical control components: (1) the refrigeration timer; (2) the defrost timer switch 210; (3) the contactor sensor and actuator 212; (4) the first contactor switch 214; (5) the second contactor switch 216; (6) the defrost terminator 218; (7) the time delay relay 220; (8) the first relay switch 222; (9) the second relay switch 224; and (10) the relay sensor and actuator 226. The following components are referred to as electromechanical components: (1) the solenoid valve 66; (2) the defrost heater 42; and (3) the damper actuators 36, 38.

In some embodiments, the first relay switch 222, the second relay switch 224, and the relay sensor and actuator 226 may be part of a single relay unit. However, the first relay switch 222, the second relay switch 224, and the relay sensor and actuator 226 may be separate electrical control components as shown in FIGS. 9A, 9B.

Similarly, in some embodiments, the first contactor switch 214, the second contactor switch 216, and the contactor sensor and actuator may be part of a single contactor unit. However, the first contactor switch 214, the second relay switch 216, and the relay sensor and actuator 226 may be separate electrical control components as shown in FIGS. 9A, 9B.

FIG. 10 shows the sub-circuit that corresponds to the control circuitry for the damper actuators 36, 38. In FIG. 10, the damper actuators 36 and 38 are connected in parallel. A power off delay timer 230 has a time delay of about 2–3 minutes before shutting off power to the damper actuators 30, 32 (shown in FIGS. 1–3). Thus, there is the same time delay of 2–3minutes in reopening the dampers 30, 32. The power off delay timer 230 is self-resetting for the next defrost mode.

FIG. 11 shows a partial view of a defroster control circuit 300 that operates substantially in the same manner as the defroster control circuit 200 shown in FIGS. 9A, 9B. The defroster control circuit 300 has a manual override timer relay 302 that an operator can activate to defrost a particular case if the operator visually detects the need for doing so. The operator activates the manual override relay 302 by manually setting the manual override relay to operate for a certain length of time, which is typically about 15 minutes.

When the operator sets the length of time, a double-throw switch 304 moves from a first position to a second position to provide power to the contactor sensor and actuator 312. The provision of power to the contactor sensor and actuator 312 causes the particular case to operate one defrost mode. The defrost mode is terminated at the length of time set by the operator on the manual override relay 302.

The defroster control circuit 300 is only shown for a single case, but it will be understood from FIG. 11 how a manual override timer relay 302 can be incorporated into any defroster control sub-circuit for any particular case in a line of cases.

For the purposes of the appended claims, the term refrigerated display case system refers to a series of refrigerated display cases and the defroster control circuit that controls the operation of the refrigerated display case system.

Although the defrost control circuit has been shown for use with refrigerated display cases that have dampers that may be moved from an open position to a closed position, the dampers 30, 32 and the damper actuators 36, 38 are not necessarily parts of the defroster control circuit. The defroster control circuits shown in FIGS. 9A, 9B and 11 may be used for sequentially defrosting evaporator coils in any series of refrigerated display cases.

The only limitation on the number of cases in a series of refrigerated display cases occurs because each case must go through the defrost cycle before the first case in the series can be defrosted again. For example, if each case required 20 minutes for each defrost mode and each case needed to be defrosted at least every five hours, then only 15 of the cases could be connected in a single defrost control circuit.

Another important feature of the defroster control circuit is that it may be independent of the electrical power supply for the refrigeration system. This independence is important first because the electrical current demands for the refrigeration system are much greater than the electrical current demands for the defroster control circuit. Second, this independence permits retrofitting existing refrigerated display cases with the defroster control circuit of the present invention. Thus, many of the advantages discussed above may now be incorporated into existing refrigerated display cases.

In this invention for a method and defroster control circuit for sequentially defrosting a series of refrigerated display cases, part of the invention lies in recognizing the need for the method and defroster control circuit described herein.

It is clear that the present invention is well adapted to carry out the objects and to attain the ends and advantages mentioned as well as those inherent therein. While presently preferred embodiments of the invention have been described in varying detail for purposes of the disclosure, it will be understood that numerous changes may be made which will readily suggest themselves to those skilled in the art and which are encompassed within the spirit of the invention disclosed and as defined in the above text and in the accompanying drawings.

What is claimed is:

1. For a series of refrigerated display cases each having an evaporator coil and operated in a refrigeration mode and a defrost mode, wherein each refrigerated display case operates in a refrigeration mode and a defrost mode independent of the refrigeration modes and defrost modes of the other display cases in the series, a method for controlling the operation of the series of refrigerated display cases to sequentially defrost the evaporator coils of the refrigerated display cases, the method comprising steps of:

(a) starting a normal refrigeration mode for all of the display cases in the series of refrigerated display cases and setting a refrigeration time equal to zero wherein, during the refrigeration mode, each display case in the series of refrigerated display cases is operating a refrigeration mode;

(b) monitoring the refrigeration time elapsed from the start of the refrigeration mode;

(c) when the refrigeration time elapsed equals an activation time, starting a defrost mode wherein, during the defrost mode, the following steps are performed:

(c1) for a first refrigerated display case, starting a defrost mode;

(c2) for the first refrigerated display case, terminating the defrost mode based on a selected one of a defrost time criterion or a defrost temperature criterion;

(c3) for the first refrigerated display case, restarting the refrigeration mode; and (c4) repeating the steps (c1) through (c3) for each successive refrigerated display case in the series of refrigerated display cases, such that no more than one refrigerated display case is in a defrost mode at any one time; and (d) terminating the defrost mode, setting the refrigeration time equal to zero and returning to the normal refrigeration mode at step (b).

2. For a series of refrigerated display cases each having an evaporator coil and operated in a refrigeration mode and a defrost mode, wherein each refrigerated display case operates in a refrigeration mode and a defrost mode independent of the refrigeration modes and defrost modes of the other display cases in the series, a method for controlling the operation of the series of refrigerated display cases to sequentially defrost the evaporator coils of the refrigerated display cases, the method comprising steps of:

(a) starting a normal refrigeration mode for all of the display cases in the series of refrigerated display cases and setting a refrigeration time equal to zero wherein, during the refrigeration mode, each display case in the series of refrigerated display cases is operating a refrigeration mode;

(b) monitoring the refrigeration time elapsed from the start of the refrigeration mode;

(c) when the refrigeration time elapsed equals an activation time, starting a defrost mode wherein the following steps are performed:

(c1) for a first refrigerated display case, starting a defrost mode comprising:

(c1i) melting the frozen condensation on the evaporator coil with a defroster heater; and (c1ii) terminating the refrigeration mode by stopping the flow of refrigerant through the evaporator coil of the display case;

(c2) for the first refrigerated display case, terminating the defrost mode based on a selected one of a defrost time criterion or a defrost temperature criterion;

(c3) for the first refrigerated display case, restarting the refrigeration mode; and (c4) repeating the steps (c1) through (c3) for each successive refrigerated display case in the series of refrigerated display cases, such that no more than one refrigerated display case is in a defrost mode at any one time; and (d) terminating the defrost mode, setting the refrigeration time equal to zero and returning to the normal refrigeration mode at step (b).

3. The method of claim 2, wherein each case of the series of refrigerated display cases has an evaporator enclosure having dampers and damper actuators and wherein the step (c1) further comprises the step of closing the dampers by the damper actuator to enclose the evaporator coil in the evaporator enclosure during the defrost mode.

4. The method of claim 2 wherein step (c3) further comprises a step of delaying the opening of the dampers at least two minutes after restarting the refrigeration mode for the defrosted display case.

5. For a series of refrigerated display cases having a refrigeration mode and a defrost mode, wherein each refrigerated display case operates in a refrigeration cycle and a defrost cycle, a method for controlling the operation of the series of refrigerated display cases and for sequentially defrosting the evaporator coils of the refrigerated display cases using a defroster control circuit, the method comprising steps of:

(a) starting a refrigeration mode for the series of refrigerated display cases and setting a refrigeration time equal to zero wherein, during the refrigeration mode, each case in the series of refrigerated display cases is operating in a refrigeration mode;

(b) monitoring the refrigeration time elapsed from the start of the refrigeration mode;

(c) starting a defrost mode when the refrigeration time elapsed equals an activation time, wherein, during the defrost mode, the defroster control circuit performs steps of:

(c1) starting a defrost mode for a first refrigerated display case by heating frozen condensation on the evaporator coil;

(c2) terminating the defrost mode for the first refrigerated display case based on either a defrost time criterion or a defrost temperature criterion;

(c3) restarting the refrigeration mode for the first refrigerated display case ; and (c4) repeating the steps (c1) through (c3) for each successive refrigerated display case in the series of refrigerated display cases, such that no more than one refrigerated display case is in a defrost cycle at any one time; and (d) returning to the refrigerator mode at step (b) when the last display case has competed the defroster mode and setting the refrigeration time equal to zero.

6. The method of claim 5, wherein each case of the series of refrigerated display cases has an evaporator enclosure having dampers and damper actuators and wherein the step (c1) further comprises the step of closing the dampers by the damper actuators to enclose the evaporator coil in the evaporator enclosure during the defrost mode.

7. The method of claim 6, wherein the step of (c2) comprises a step of turning off the defroster heater, and the defrost time criteria is when the elapsed defrost time has reached a maximum predetermined time.

8. The method of claim 7 wherein step (c3) further comprises a step of delaying the opening of the dampers at least two minutes after restarting the refrigeration mode for the defrosted display case.

9. The method of claim 5 further comprising the step of activating a manual override timer relay for at least one particular refrigerated display case, wherein, when an operator activates the manual override timer relay, a defrost cycle starts for the particular refrigerated display case.

10. A refrigerated display case system, comprising:

(a) a series of refrigerated display cases, each having an evaporator coil; and (b) a defroster control circuit to control the operation of the refrigerated display case system and to sequentially defrost the evaporator coils by steps of:

(i) starting a normal refrigeration mode for the series of refrigerated display cases;

(ii) at a beginning of the normal refrigeration mode, setting a refrigeration time equal to zero and subsequently monitoring an elapsed refrigeration time;

(iii) when the elapsed refrigeration time equals an activation time, performing the steps of:

(iiiA) for a first refrigerated display case, starting a defrost mode to melt condensation from the evaporator coils; and (iiiB) for the first refrigerated display case, terminating the defrost mode based on either a defrost time criterion or a defrost temperature criterion;

(iiiC) for the first refrigerated display case, restarting the refrigeration mode; and (iiiD) repeating steps (iiiA) to (iiiC) for successive refrigerated display cases in the series of refrigerated display cases; and (iv) terminating the defrost mode, setting the refrigeration time equal to zero and returning to the normal refrigeration mode at step (ii).

11. The defrost control circuit of claim 10 wherein each of the refrigerated display cases has dampers that move between an open position and a closed position, and wherein, when the dampers are in the closed position, the dampers form part of an evaporator enclosure to retard heat transfer from an area near each evaporator coil during the defrost mode.

12. The defroster control circuit of claim 11 further comprising electromechanical components, including:

(a) a solenoid valve to shut off a flow of refrigerant through the evaporator coil;

(b) a defroster heater to melt condensation on an outside of the evaporator coil;

(c) damper actuators that move dampers from the open position to the closed position.

13. The method of claim 10 wherein step (c3) further comprises a step of delaying the opening of the dampers at least two minutes after restarting the refrigeration mode for the defrosted display case.

14. The method of claim 10 wherein the step of (iiiB) comprises turning off the defroster heater, and the defrost time criteria is when the elapsed defrost time has reached a predetermined value.

* * * * *